US008590254B2

(12) United States Patent
Garrett

(10) Patent No.: US 8,590,254 B2
(45) Date of Patent: Nov. 26, 2013

(54) DECK BLOCK

(75) Inventor: David Michael Garrett, Oklahoma City, OK (US)

(73) Assignee: Buildblock Building Systems, LLC, Oklahoma City, OK (US)

( * ) Notice: Subject to any disclaimer, the term of this patent is extended or adjusted under 35 U.S.C. 154(b) by 246 days.

(21) Appl. No.: 12/853,078

(22) Filed: Aug. 9, 2010

(65) Prior Publication Data

US 2011/0047920 A1 Mar. 3, 2011

Related U.S. Application Data

(60) Provisional application No. 61/232,235, filed on Aug. 7, 2009.

(51) Int. Cl.
*E04B 5/04* (2006.01)
*E04C 2/04* (2006.01)

(52) U.S. Cl.
USPC ..... 52/607; 52/605; 52/606; 52/323; 52/302.4; 52/503; 52/592.1; 52/505; 52/444; 52/576

(58) Field of Classification Search
USPC ..... 52/259, 320, 322, 323, 302.4, 793.1, 52/309.12, 309.17, 414, 405.1, 405.3, 503, 52/504, 505, 220.1, 220.2, 220.3, 220.4, 52/220.5, 220.8, 444, 576, 577, 236.8, 52/236.5, 604, 605, 606, 607, 592.1; 405/284, 262
See application file for complete search history.

(56) References Cited

U.S. PATENT DOCUMENTS

| | | | | |
|---|---|---|---|---|
| 4,157,640 | A * | 6/1979 | Joannes | 52/309.7 |
| 5,144,782 | A | 9/1992 | Paquette et al. | |
| 5,729,943 | A * | 3/1998 | Cambiuzzi | 52/438 |
| 5,802,797 | A * | 9/1998 | Storer-Folt | 52/604 |
| 5,934,037 | A * | 8/1999 | Bundra | 52/603 |
| 6,202,381 | B1 * | 3/2001 | Dame et al. | 52/745.1 |
| 6,298,622 | B1 * | 10/2001 | Cretti | 52/309.7 |
| 6,431,792 | B1 * | 8/2002 | Barnes | 405/25 |
| 6,457,288 | B2 | 10/2002 | Zambelli et al. | |
| 6,691,485 | B1 * | 2/2004 | Prokofyev | 52/604 |
| 7,784,235 | B2 * | 8/2010 | Cretti | 52/332 |
| 7,814,719 | B2 * | 10/2010 | Cretti | 52/340 |
| 7,954,291 | B2 * | 6/2011 | Cretti | 52/309.16 |
| 8,006,450 | B2 * | 8/2011 | Cretti | 52/320 |

FOREIGN PATENT DOCUMENTS

| | | |
|---|---|---|
| JP | 06-185153 | 7/1994 |
| JP | 09-165864 | 6/1997 |

OTHER PUBLICATIONS

International Search Report and Written Opinion (PCT/US2010/044897); Apr. 27, 2011.

* cited by examiner

*Primary Examiner* — Chi Q Nguyen
(74) *Attorney, Agent, or Firm* — Dunlap Codding, P.C.

(57) ABSTRACT

A deck block adapted to be interconnected with other deck blocks to form an insulating deck for casting concrete. The deck block comprising a foam panel at least one hole extending into the panel from the one end toward an opposing end such that the hole has an open end and a closed end. At least one protrusion extends from the panel and the protrusion is matingly receivable in at least a portion of a hole of a like panel to interconnect the panels in an end-to-end relationship. The panel has a vertical groove extending from a bottom surface and intersecting the opening of the panel to provide a fluid flow channel from the opening to the bottom surface of the panel when the like panels are interconnected. The protrusion has a horizontal groove extending along a lower end thereof from a distal end of the protrusion to a proximal end thereof so as to intersect the vertical groove.

15 Claims, 10 Drawing Sheets

DECK BLOCK

CROSS-REFERENCE TO RELATED APPLICATIONS

This application claims benefit of U.S. Provisional Application No. 61/232,235, filed Aug. 7, 2009, which is incorporated herein by reference in its entirety.

BACKGROUND OF THE PRESENTLY DISCLOSED AND/OR CLAIMED INVENTIVE CONCEPTS

1. Field of the Presently Disclosed and/or Claimed Inventive Concepts

The inventive concepts disclosed and claimed herein relate to a deck block system, and more particularly, but not by way of limitation, to a deck block provided with a liquid drainage system.

2. Brief Description of Related Art

The construction of suspended flooring and/or roofing systems is well known in the art. Suspended flooring and/or roofing systems are typically constructed from a plurality of joists, struts, trusses, beams, or combinations thereof attached to the walls of a structure. Once the supporting frame is in place, a subfloor is typically installed on top of the floor frame. Common types of subflooring include steel members which are welded together, plywood sheets, composite decking, or combinations thereof. The final floor includes a layer of concrete that is poured over the subflooring. Additionally, certain types support framing requires the addition of insulation between the beams and joists of the support framing for noise attenuation and climate control within the structure.

To overcome some of the limitations of common construction methods for building suspended flooring and/or roofing systems, insulated block systems have been utilized to form insulated decking for supporting concrete flooring or roofing. In these systems, each of the blocks typically includes one or more projections and grooves for interlocking the blocks together to form the insulated decking. While the projection and groove combination adequately secures one block to another, such block systems suffer from the drawback of unwanted buildup and/or trapping of condensate or other liquids within various portions of the insulated blocks when the blocks are joined together to form the insulated deck. Fluid trapped within the insulated deck can be deleterious to the performance and safety of the insulated deck and/or the concrete poured over the insulated deck.

In addition, a typical insulated block deck is formed from a plurality of courses of interlocked blocks disposed adjacently to one another to cover the supporting frame. To provide additional structural support, the insulated deck may include support members such as T-shaped or I-beam support members disposed between each of the courses of interlocked blocks. Unfortunately, the fabrication and use of these T-shaped or I-beam support members can be costly.

To this end, a need exists for a deck block for use in constructing concrete flooring and roofing that overcomes the problems experienced with use of the prior art systems. It is to such a deck block that the inventive concepts disclosed and claimed herein are directed.

DETAILED DESCRIPTION OF EXEMPLARY EMBODIMENTS

Figure 1:
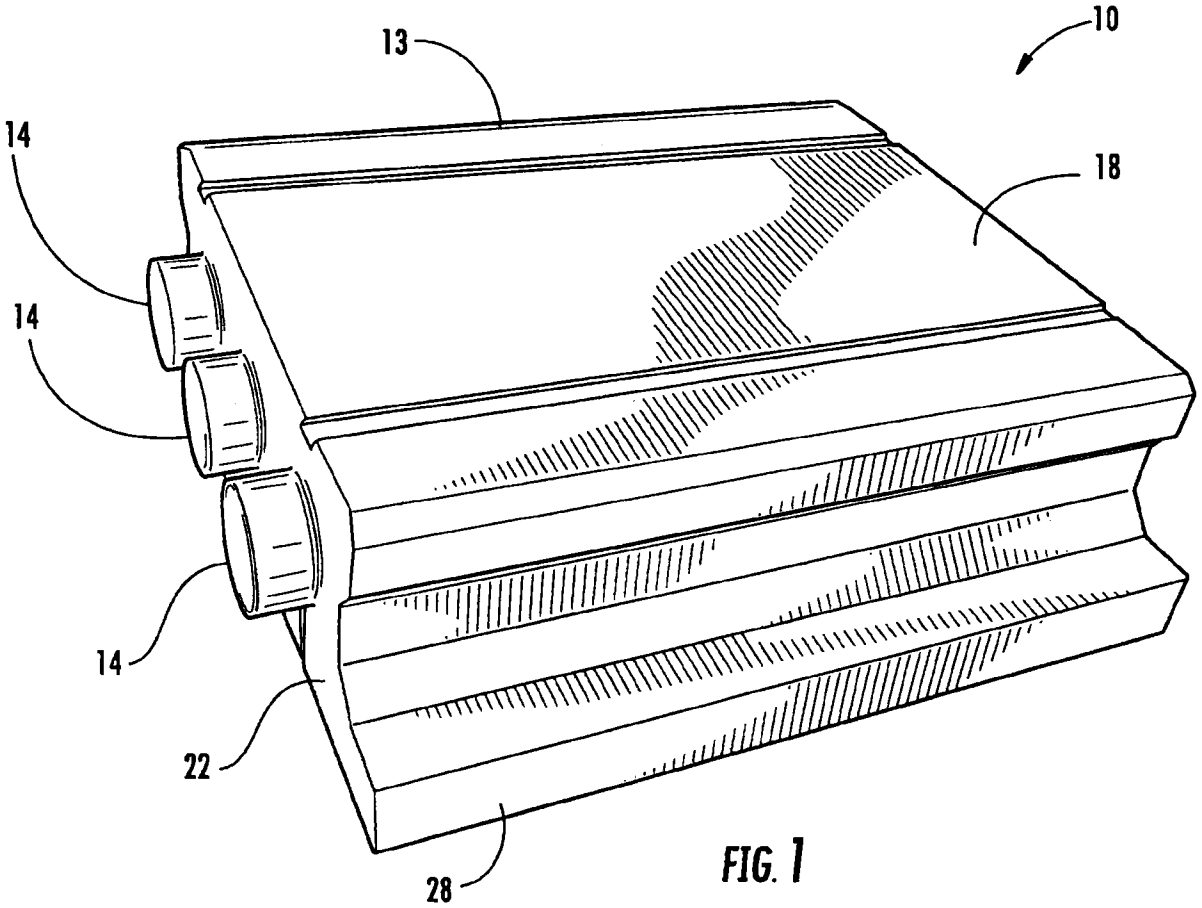
FIG. 1 is a perspective view of a deck block constructed in accordance with the inventive concepts disclosed and claimed herein.
Figure 2:
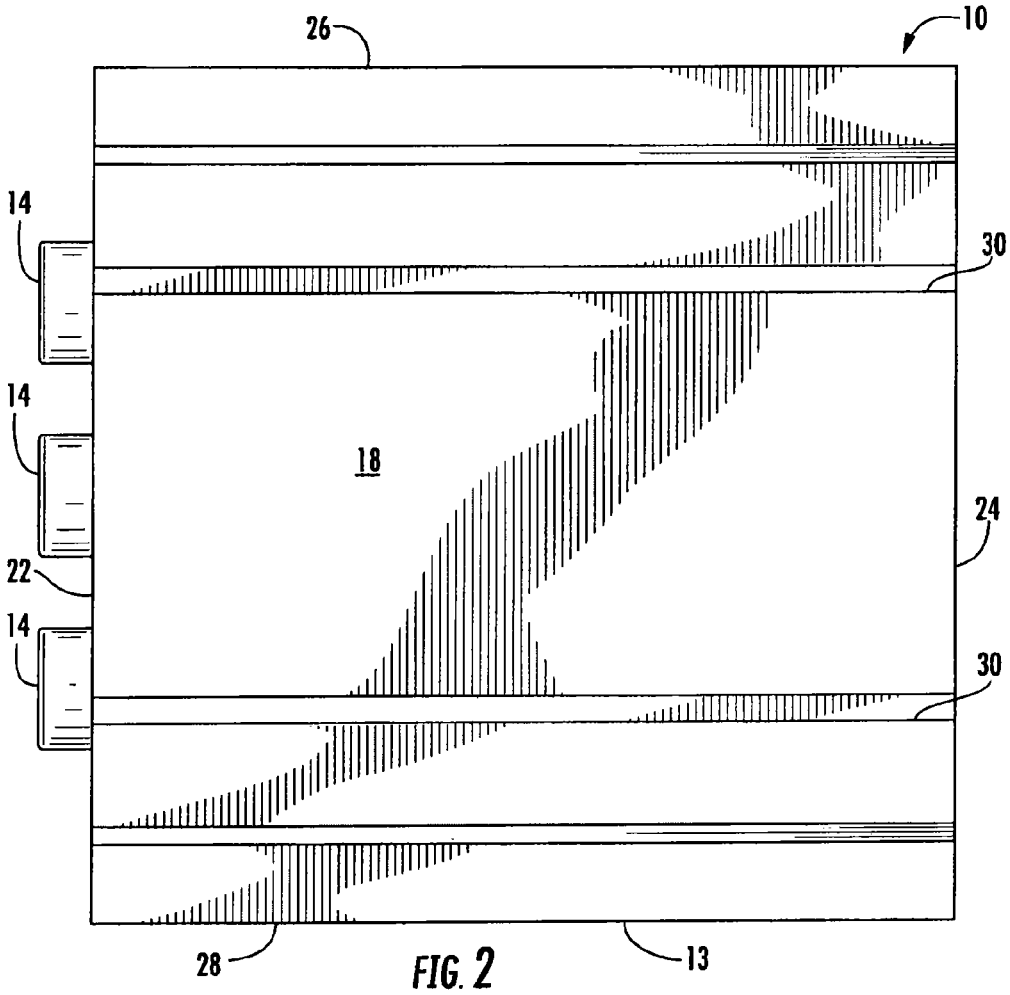
FIG. 2 is a top plan view of the deck block of FIG. 1.
Figure 3:
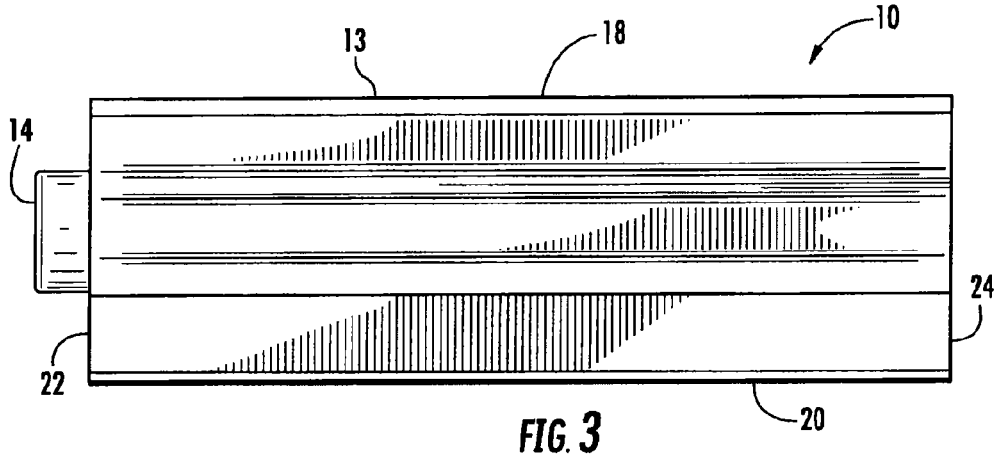
FIG. 3 is a side elevation view of the deck block of FIG. 1.

Referring now to the drawings, and more particularly to FIGS. 1-6, shown is a deck block 10. The deck block 10 is adapted to be interlocked with like deck blocks to form an insulating deck 12 (FIG. 13) for forming a concrete floor. In another use, a plurality of deck blocks 10 may be utilized to construct an insulating deck for supporting a concrete roof of a structure. Broadly, the deck block 10 has a panel 13, at least one projection 14, and at least one opening 16 (FIGS. 5 and 6) for matingly receiving the projection of a like deck block 10. The deck block 10 may be formed as a single unit from fire retardant expanded polypropylene, polystyrene, polyethylene or other suitable polymers with expanded polystyrene commonly referred to as "EPS" being preferred.

Figure 12:
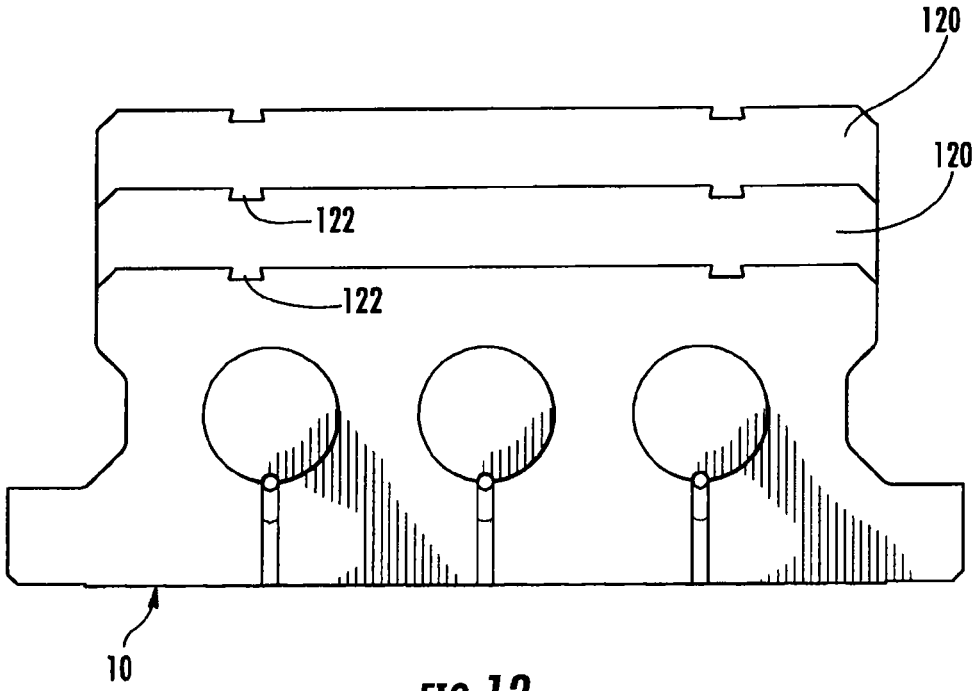
FIG. 12 is a front end view of the deck block shown in association with two top caps.

As shown in FIGS. 1-6, the panel 13 has a top surface 18, a bottom surface 20, a first end 22, a second end 24, a first side 26, and a second side 28. The top surface 18 is substantially planar in configuration, but may be provided with one or more grooves 30. The grooves 30 are shaped to receive at least one support member, such as a strapping bracket 32 (FIG. 7), which in turn retains and supports a reinforcing member 34 (FIG. 7), such as a length of rebar, a spaced distance above the top surface 18 of the panel 13. Additionally, when two or more blocks 10 are joined together in an end-to-end relationship, the grooves 30 cooperate to form a continuous groove 30 along the entire length of the course of blocks 10 of the deck or roof 12 (FIG. 12).

Figure 4:
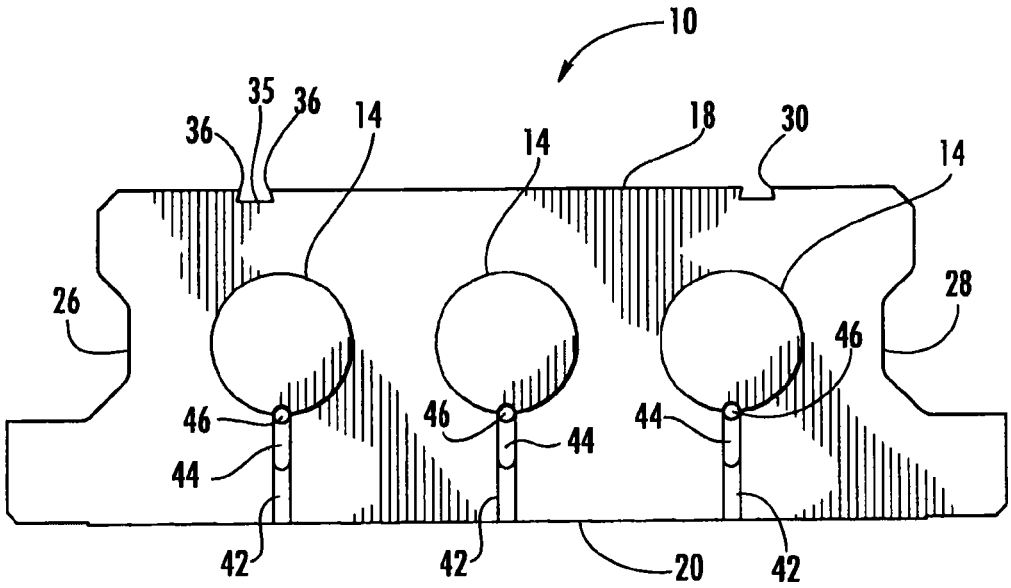
FIG. 4 is a front end view of the deck block of FIG. 1.

Referring to FIG. 4, the grooves 30 have a lower surface 35 and two angled side walls 36 that extend upwardly and inwardly from the lower surface 35. The lower surface 35 and side walls 36 cooperate to form a frusto-conical shaped opening. The frusto-conical shape of the grooves 30 operates to retain a portion of the support members 32 (FIG. 7) without the need to attach the support members 32 with a fastener; although in one embodiment, the use of a fastener such as a nail, a threaded fastener, a clip, an adhesive, or the like may be desired. Also, while the grooves 30 have been disclosed as having a frusto-conical shape, one of ordinary skill in the art will appreciate that many other shapes could be utilized to accomplish the function provided by the grooves 30, namely the support of at least a portion of the at least one support member therein.

The deck block 10 is shown to include three projections 14 (FIGS. 1-4, and 6) extending from the first end 22 of the panel 13, and three corresponding openings 16 (FIGS. 5 and 6) formed in the second end 24 of the panel 13. Each of the openings 16 is axially aligned with one of the corresponding projections 14. The projections 14 may be of any geometrical shape and size such as cylindrical, triangular, cubic, irregular, and the like. It will be understood that the projections 14 and the openings 16 have corresponding configurations and that the projections 14 are sized such that they may be inserted matingly within the openings 16 of an adjacent like deck block 10, and that the openings 16 may receive the projections 14 of an adjacent like deck block 10. More specifically, the outer surfaces of the projections 14 may matingly contact the inner surfaces of the openings 16. The openings 16 extend from the second end 24 of the panel 13 inwardly through the panel 13 toward the first end 22. It will be understood that the number of projections 14 and openings 16 may be varied as well as the shape and size of the projections 14 and the openings 16, including the length of the openings 16.

The deck block 10 includes a drainage system to permit condensate or other liquid to drain from the deck block 10 when two or more blocks 10 are joined together. With two or more blocks 10 interlocked such that the projections 14 of one block are matingly received within the openings 16 of another deck block 10, the drainage system of each of the blocks cooperates to form a continuous drainage path along each course of the blocks 10 of the deck or roof 12. It will be understood that the design of the drainage system preferably enables condensate or other liquid to flow from the blocks 10 regardless of the angle of inclination of the blocks 10.

The drainage system includes the openings 16. More specifically, the openings 16 are formed such that the condensate or other liquid may flow through the openings 16. To facilitate drainage, the opening 16 may be tapered from one end to the other. For example, the opening 16 may be tapered from an open end 38 of the opening 16 (FIG. 6) to a closed end 39 (FIG. 6) so as to direct fluid toward the closed end 39, or the opening 16 may be tapered from the closed end 39 to the open end 38 to direct fluid toward the open end 38. In one embodiment, the taper may have a slope within a range from about 1° to about 3°. However, it will be appreciated that the slope of the taper may be varied.

The drainage system further includes a vertical slot or groove 42 formed in the first end 22 of the panel 13. The vertical groove 42 extends from the bottom surface 20 to the lower side of the projection 14. The vertical groove 42 is configured to intersect with the closed end 39 of the opening 16 at a lower end thereof to create a fluid flow channel from the opening 16 to the bottom surface 20 of the panel 13 when two blocks 10 are connected to one another with the first end 22 of one deck block 10 abutting the second end 24 of another deck block 10. To facilitate fluid flow from the opening 16, the vertical groove 42 may include a sloped or angled portion 44 extending from the closed end 39 of the opening 16. It will be appreciated that generally one vertical groove 42 will be provided for each opening 16 of the block 10

The drainage system of the deck block 10 also includes a horizontal groove or slot 46 extending along the lower side of each of the projections 14. The horizontal groove 46 extends from a distal end of the projections 14 to a proximal end of the projections 14 so as to intersect with the vertical grooves 42 and thereby provide a fluid flow channel from the open end 38 of the opening 16 to the bottom surface 20 when two blocks 10 are connected to one another. It will be appreciated that the vertical groove 42 intersecting with the closed end 39 of the opening 16 provides a fluid flow channel from the closed end 39 of the opening 16, and the horizontal groove 46 in combination with the vertical groove 42 provides a fluid flow channel from the open end 38 of the opening 16, thereby allowing liquid to drain from the opening 16 of the deck block 10 regardless of the angle of inclination of the deck block 10. However, it should be appreciated that the drainage system 40 may be configured to provide only one fluid flow channel from the opening 16 so long as the opening 16 and/or the deck block 10 are angled to permit liquid to drain from the single fluid flow channel. For example, the projections may include the horizontal groove and the first end 22 may include a vertical groove that does not intersect the opening 16 or the second end 24 of the panel 13 may include a vertical groove (not shown) that cooperates with the horizontal groove 46 to provide a fluid flow channel to the bottom side 20 of the panel 13. It should also be appreciated that while the grooves 42 and 46 have been shown to have a substantially arched configuration, other configurations, such as rectangular, square, triangular, or combinations thereof, may be used to form the vertical and horizontal grooves 42 and 46. Finally, it should be appreciated that the size of the vertical and horizontal grooves 42 and 46 may be varied.

Figure 5:
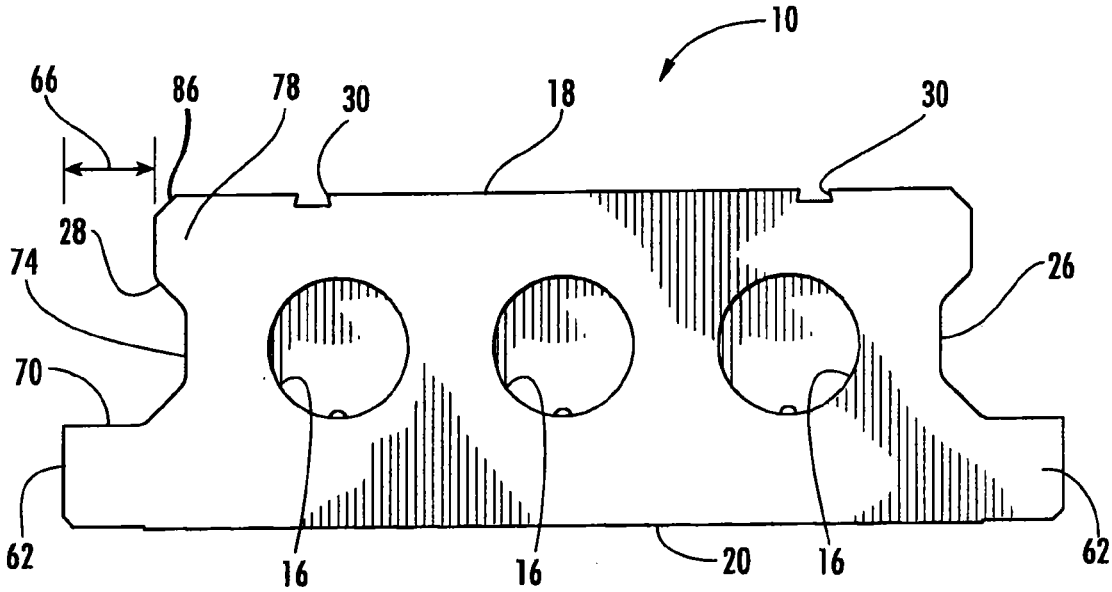
FIG. 5 is a back end view of the deck block of FIG. 1.
Figure 6:
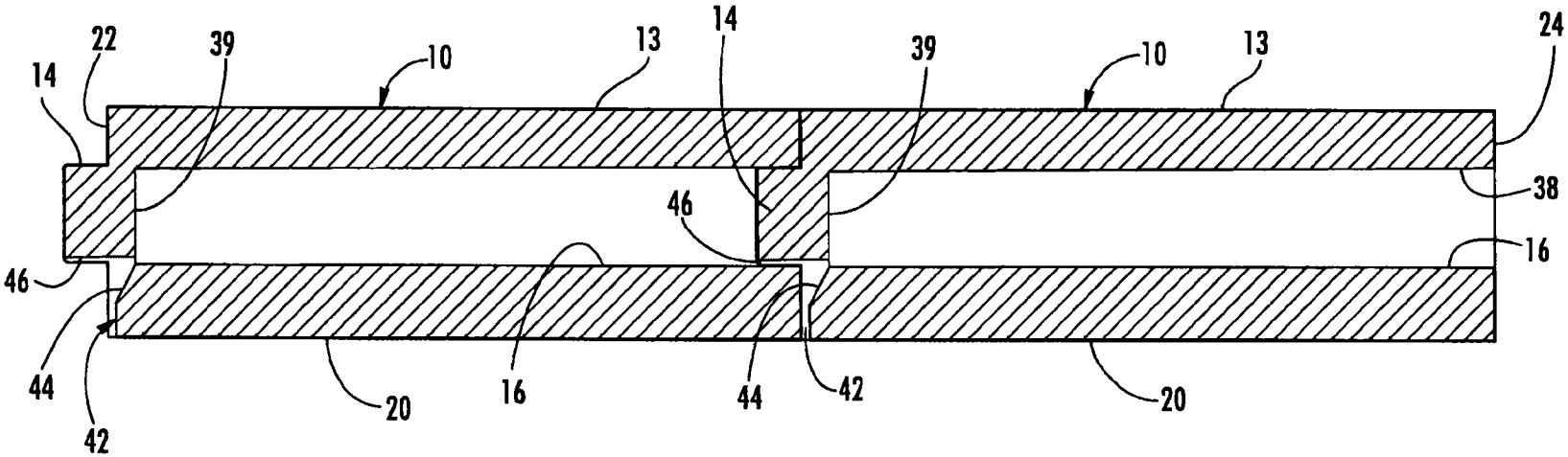
FIG. 6 is a cross sectional view of two deck blocks connected to one another.
Figure 7:
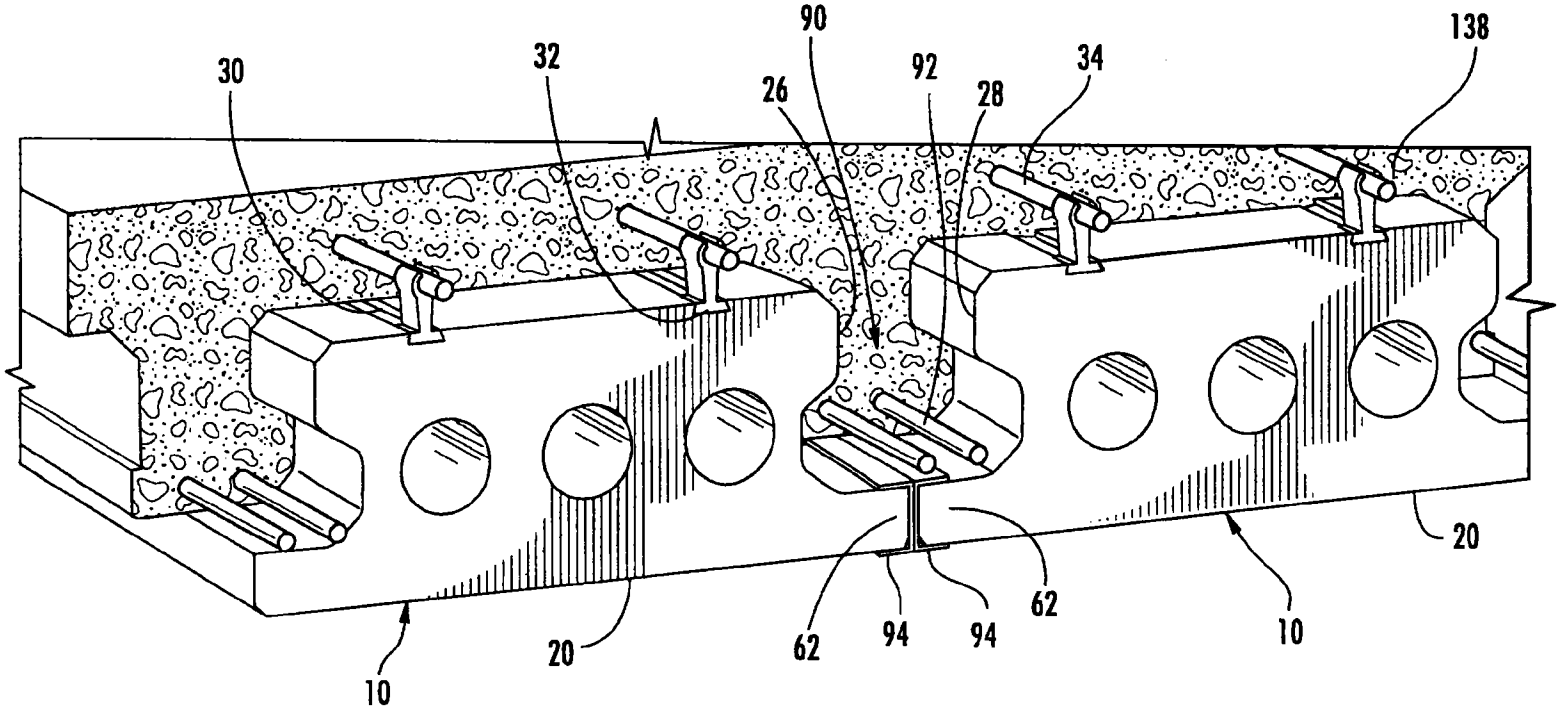
FIG. 7 is a perspective view of a portion of a concrete deck showing two deck blocks placed in a side-by-side relationship.

FIG. 7 shows a pair of deck blocks 10 positioned in a side-by-side relationship having had a volume of concrete poured over the deck blocks 10. Each of the first side 26 and the second side 28 includes a mating portion 62 which mirrors a mating portion 62 of an adjacent deck block 10. Referring to FIG. 5, the mating portion 62 extends at a distance 66 from the edge of the top of the first and second sides 26 and 28 and includes an upper surface 70. The upper surface 70 defines a portion of a substantially C-shaped channel portion 74 disposed above the mating portion 62. Additionally, the first and second sides 26 and 28 include an upper portion 78 disposed above the substantially C-shaped channel portion 74. In accordance with the present invention, the upper portion 78 includes a vertical edge 82 which transitions to the top surface 18 of the block 10 via a beveled edge 86. It will be understood that while the first and second sides 26 and 28 have been disclosed as having a particular geometrical configuration, any number of geometrical configurations that would be known to one of ordinary skill in the art with the present disclosure before them are likewise contemplated for use in accordance with the present invention.

When two blocks 10 are positioned side-by-side (FIG. 7), the mating portions 62 of adjacent blocks 10 are disposed in face-to-face relationship with one another, such that the first and second sides 26 and 28 of the laterally disposed blocks 10 form a channel 90 for receiving a reinforcing material 92 such as rebar, concrete, or the like. It will be understood that the shape of the channel 90 formed by the blocks 10, namely the C-shaped channel portions 74, functions to bond the blocks 10 to the concrete poured into the channel 90. Furthermore, the shape of the channel 90 creates a bottom cord of concrete that provides additional strength similar to an I-beam. More specifically, the concrete poured into the channel 90 and above the blocks 10 cooperates to form a series of interconnected I-beams of concrete.

Figure 8:
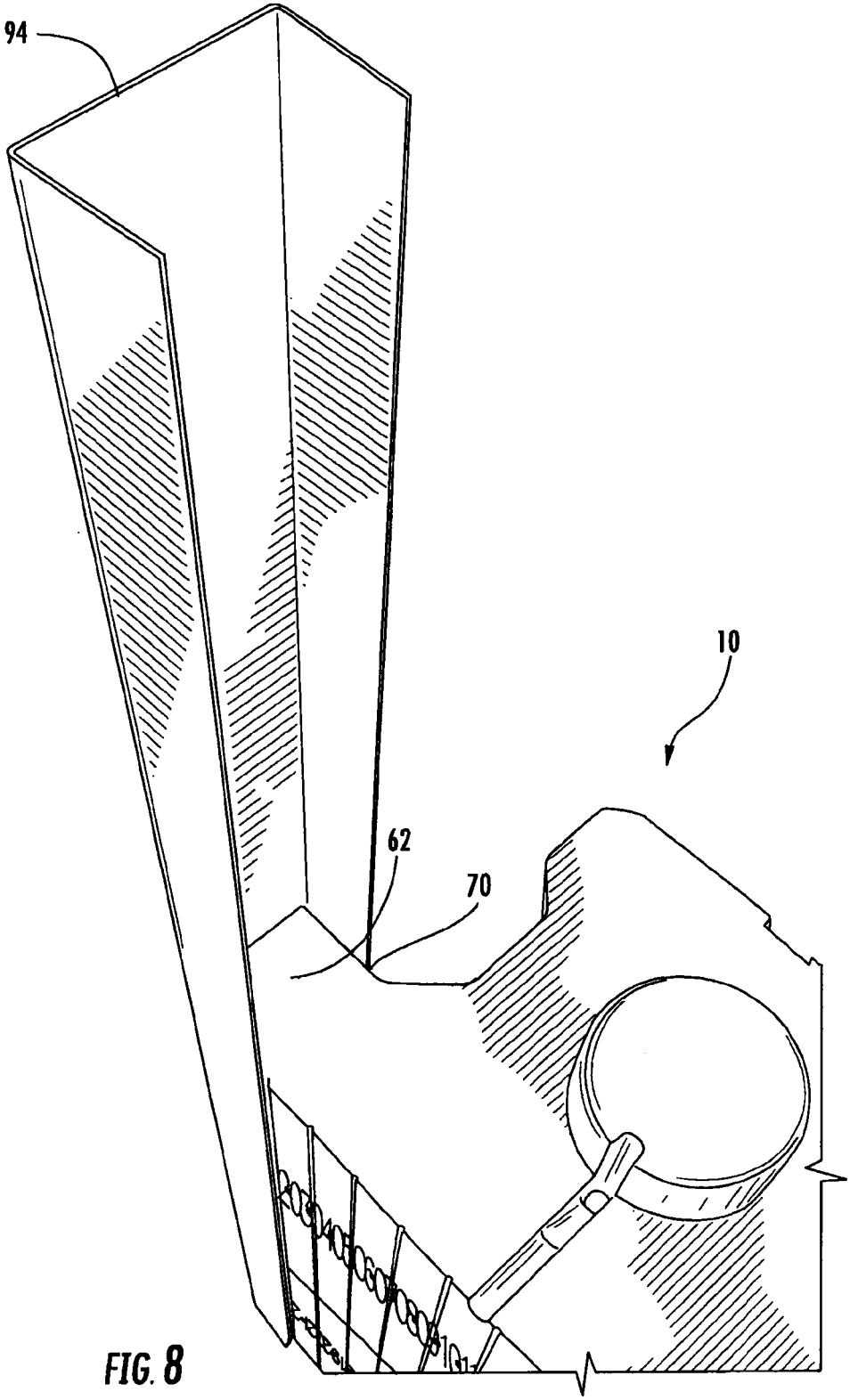
FIG. 8 is a perspective view of the deck block in association with an end cap.
Figure 9:
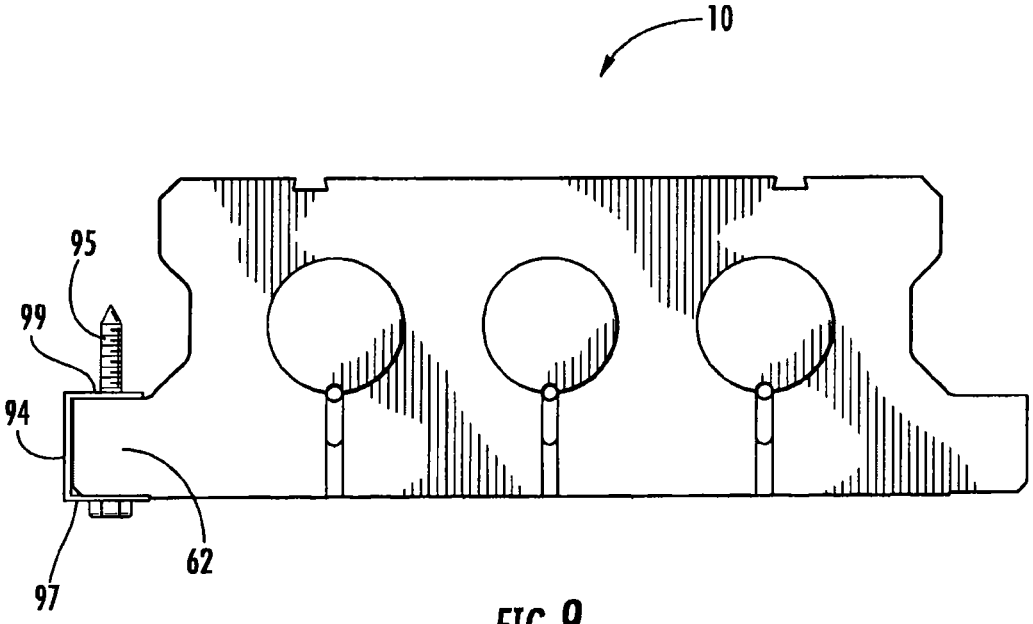
FIG. 9 is a front elevational view illustrating a fastener joining the end cap to the deck block.

Referring now to FIGS. 8 and 9, to provide additional support, an end cap 94 may be positioned over the mating portions 62. The end cap 94 is a U-shaped channel that is sized to cover at least a portion of the mating portion 62 of the block 10. The end cap 94 may be formed from a rigid, durable material such as a metal, plastic, resin, composite, natural material, or any combination thereof. As shown in FIG. 7, a pair of end cap 94 may be attached to one another in a back-to-back relationship with fasteners or by welding. In other embodiments, only one end cap 94 might be positioned between adjacent blocks 10, or the blocks 10 might be positioned without any end caps 94 positioned there between.

The end cap 94 provides structural support to the mating portion 62. Furthermore, when two or more blocks 10 are interlocked together linearly to form a contiguous length of blocks 10, the end caps 94 cover the mating portions 62 of the two or more blocks 10 to provide support and reduce unwanted deflection of the blocks 10 when a load is applied thereto. The end cap 94 also provides an attachment point for joining two courses of blocks 10 together with fasteners or adhesive. The end cap 94 may also provide a contact point for support bracing during construction of the deck or roof 12 as will be discussed in greater detail below. Additionally, the end cap 94 provides an anchoring surface for attachment of drywall materials or other items such as lighting, fans, sprinklers, and the like to the blocks 10.

The end cap 94 may be secured to the mating portions 62 of the blocks 10 in a variety of ways. One such way is with a plurality of fasteners 95 (FIG. 9). The fasteners 95, such as screws, are inserted upwardly through a first flange 97 of the end cap 94, through the mating portion 62 of the deck block 10, and upwardly through a second flange 99 of the end cap 94, extending a distance beyond the second flange 99. The portion of the fastener 95 extending beyond the second flange 99 is embedded within the concrete poured into the channel 90 and acts to securely bond the end caps 94 to the concrete such that if the blocks 10 are compromised, the end caps 94 may remain securely connected to the concrete for safety.

Figure 10:
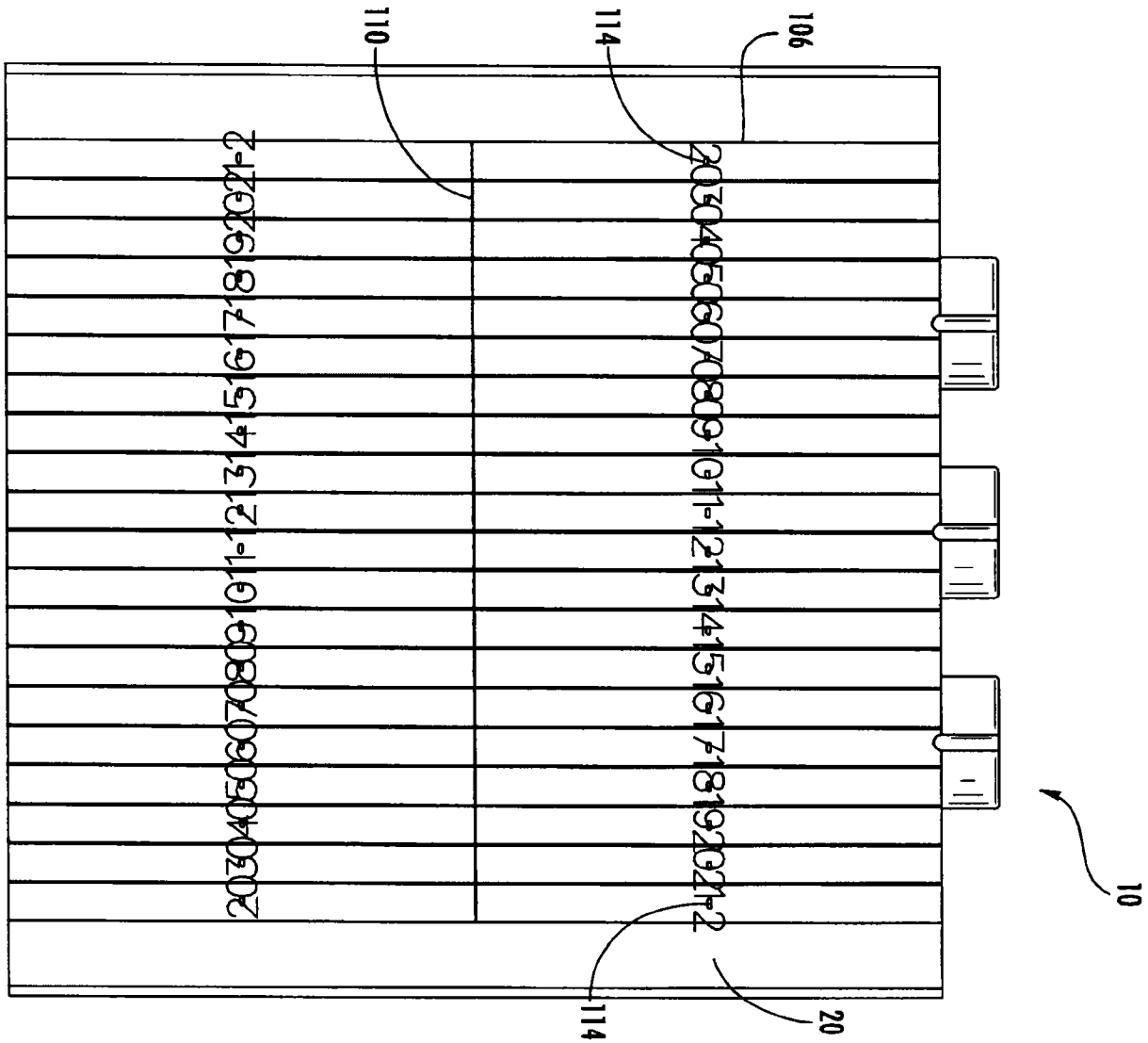
FIG. 10 is a bottom plan view of the deck block of FIG. 1.

FIG. 10 illustrates the bottom surface 20 of the deck block 10. The bottom surface 20 is provided with a series of lateral markings 106 that serve as guidelines for assisting the installer to cut the deck block 10 to a desired size. The lateral markings 106 are preferably spaced at one inch intervals; however, it will be appreciated that other intervals may be used. In addition, the lateral markings 106 are identified with numerals much like a measuring tape. This allows an installer to cut blocks many times without the need of marking the cut point on the block, or eliminating the need to measure the form during the installation or cutting process of installation. This will save time and money during the installation process. The markings also include a center line 110 for allowing an installer to divide the blocks 10 in half and a dashed lines 114 for allowing an installer to divide the blocks 10 into quarters.

Figure 11:
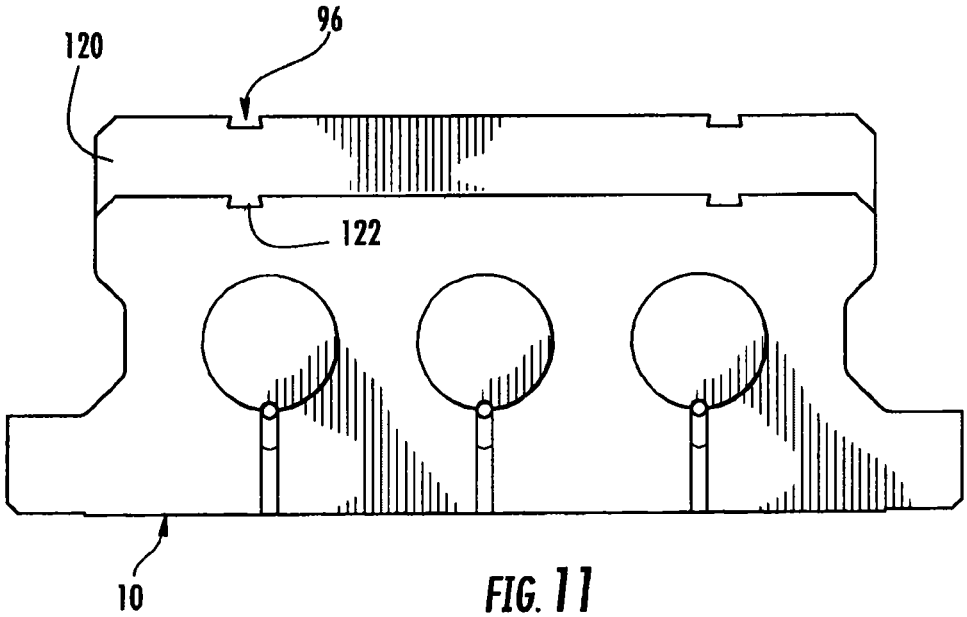
FIG. 11 is a front end view of the deck block shown in association with a top cap.

Referring now to FIGS. 11 and 12, the blocks 10 may also be provided with a cap 120 (FIG. 11) or more than one cap 120 (FIG. 12) for increasing the height of the blocks 10. It will be understood that increasing the height of the blocks 10 will increase the height of the channel 90 formed between adjacent blocks 10 and increase the insulating capacity of the deck or roof 12 (FIG. 13), the height of the channel 90, and ultimately the height of the column of concrete within the channel 90 (FIG. 7). The top caps 120 may be formed having any shape and/or size, but in one embodiment, the top caps 120 are substantially identical in configuration to the top portion of the deck block 10. The top caps 120 may include engaging tabs 122 disposed along the bottom of the top caps 120 for engaging the grooves 30 of the blocks 10 to secure the top cap 120 to the deck block 10. It will be understood that although it has been disclosed that the height of the blocks 10 may be increased by providing top caps 120, the blocks 10 may be formed having varying heights and sizes rather than including various sized top caps 120.

Figure 13:
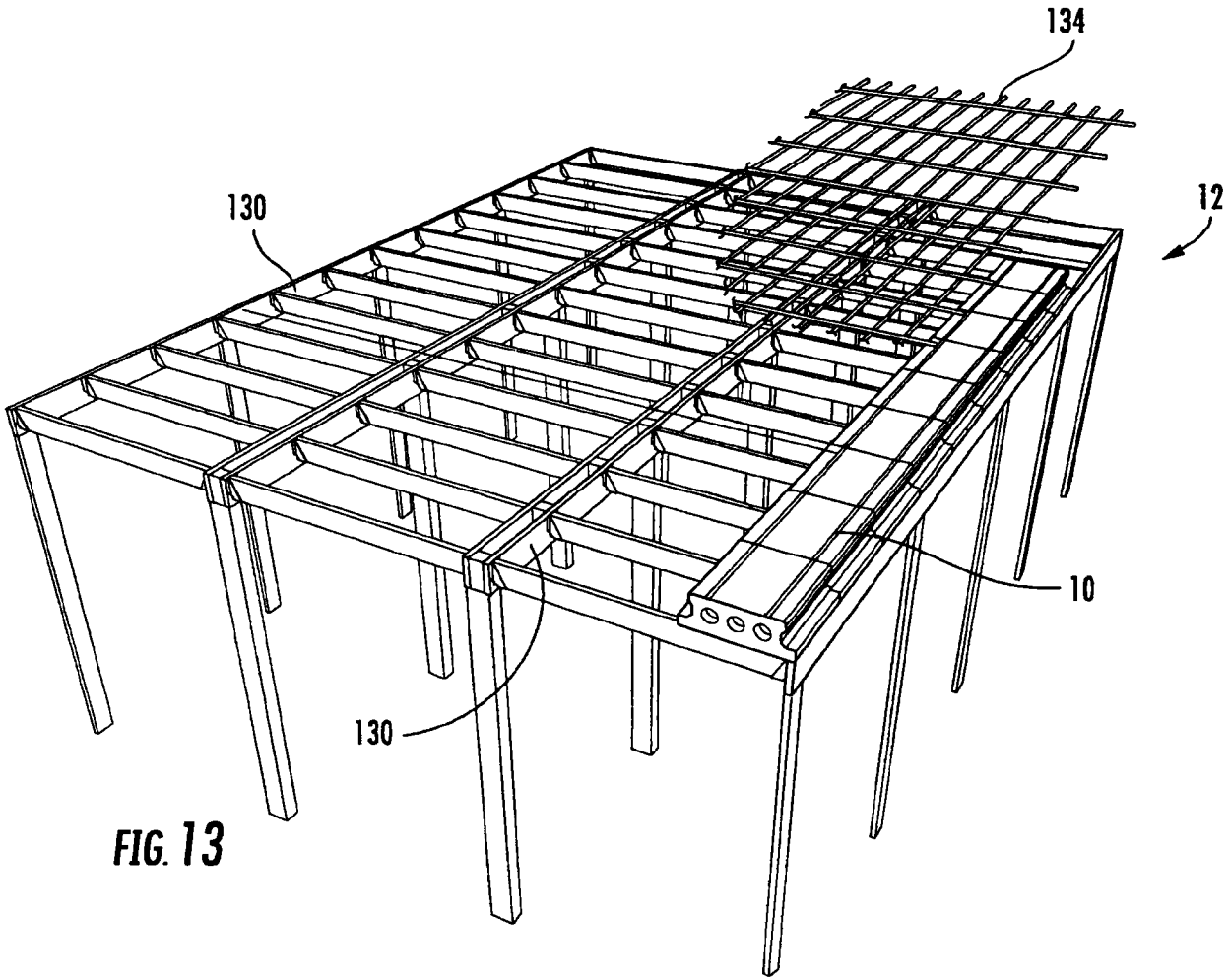
FIG. 13 is an exploded, partial perspective view illustrating the construction of a deck made from a plurality of deck blocks.

Referring now to FIGS. 7 and 13, in operation, a plurality of blocks 10 are joined together to form a deck or roof 12 for supporting a concrete floor or roof. A temporary or permanent supporting frame 130 is constructed to receive the blocks 10. The supporting frame 130 may be constructed as a permanent or temporary support structure that can suspend the plurality of blocks 10 above the ground at a predetermined distance. For example, the supporting frame 130 may include a typical beam and joist frame that spans the walls of the structure.

Once the supporting frame 130 is installed, the blocks 10 are assembled and placed into position such that the bottom surface 20 of the blocks 10 contacts the supporting frame 130. The deck or roof 12 is formed by creating a plurality of courses of linearly interlocked blocks 10 in the manner described above. One course of blocks 10 is placed next to an adjacent course of blocks 10 in an abutting relationship such that the end cap 94 of one course contacts the end cap 94 of an adjacent course. Additional courses of blocks 10 are installed similarly until the deck or roof 12 is formed. Next, rebar or another reinforcing material 92 is disposed within the channels 90 formed by the placement of one course of blocks 10 adjacently to another course of blocks 10. Additionally, rebar 34 is disposed in a linear, perpendicular, or combined pattern along the top of the deck or roof 12 via the support members 32 of the blocks 10. In this embodiment, the deck or roof 12 is provided with a rewire mesh 134 which is secured to the support members 32 installed in the grooves 30 of the blocks 10. Once the reinforcing materials have been disposed or secured to the blocks 10, concrete 138 is poured over the deck or roof 12 and allowed to cure for a predetermined amount of time in order to form the final concrete deck or roof. In one embodiment, once the concrete 138 has cured, the supporting frame 130 is removed. In an additional embodiment, the supporting frame 130 is kept in place.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and described in the appended claims.

What is claimed is:

1. A deck block adapted to be interconnected with other deck blocks to form an insulating deck for casting concrete, the deck block comprising:

a foam panel having a top surface, a bottom surface, a first end, a second end opposite the first end, a first side, a second side opposite the first side, and at least one opening extending from the second end inwardly through a portion of the panel toward the first end such that the opening has an open end at the second end of the panel and a closed end spaced a distance from the first end of the panel; and at least one protrusion extending from the first end of the panel, the protrusion being matingly receivable in at least a portion of an opening of another deck block panel to interconnect the panel with said another deck block panel in an end-to-end relationship, wherein the first end of the panel has a vertical groove extending from the bottom surface and intersecting the opening of the panel to provide a fluid flow channel from the opening to the bottom surface of the panel when the panel is interconnected to said another deck block panel.

2. The deck block of claim 1 wherein the vertical groove extends from the bottom surface to a lower end of the protrusion.

3. The deck block of claim 2 wherein the vertical groove has an angled portion extending from the opening to the first end of the panel and spaced a distance above the bottom surface of the panel.

4. The deck block of claim 1 wherein the protrusion has a horizontal groove extending along a lower end thereof from a distal end of the protrusion to a proximal end thereof so as to intersect the vertical groove.

5. The deck block of claim 4 wherein the vertical groove extends from the bottom surface to the lower end of the protrusion.

6. The deck block of claim 5 wherein the vertical groove has an angled portion extending from the closed end of the opening to the first end of the panel and spaced a distance above the bottom surface of the panel.

7. The deck block of claim 1 wherein the top surface is provided with at least one groove extending from the first end to the second end.

8. The deck block of claim 7 wherein the groove has a frusto-conical profile.

9. The deck block of claim 1 wherein the opening is tapered.

10. A deck block adapted to be interconnected with other deck blocks to form an insulating concrete form for casting concrete, the deck block comprising:

a foam panel having a top surface, a bottom surface, a first end, a second end opposite the first end, a first side, a second side opposite the first side, and at least one opening extending from the second end inwardly through a portion of the panel toward the first end such that the opening has an open end at the second end of the panel and a closed end spaced a distance from the first end of the panel; and at least one protrusion extending from the first end of the panel, the protrusion being matingly receivable in at least a portion of an opening of another deck block panel so that the panel is interconnectable with said another deck block panel in an end-to-end relationship, the protrusion having a horizontal groove extending along a lower end of the protrusion from a distal end of the protrusion to a proximal end thereof, wherein at least one of the first end and the second end of the panel has a vertical groove extending from the bottom surface and intersecting the horizontal groove to provide a fluid flow channel from the opening to the bottom surface of the panel when the panel is interconnected to said another deck block panel.

11. The deck block of claim 10 wherein the horizontal groove intersects the opening of the panel.

12. The deck block of claim 10 wherein the opening is tapered.

13. A deck block adapted to be interconnected with other deck blocks to form an insulating concrete form for casting concrete, the deck block comprising:

a foam panel having a top surface, a bottom surface, a first end, a second end opposite the first end, a first side, a second side opposite the first side, and at least one opening extending from the second end inwardly through a portion of the panel toward the first end such that the hole opening has an open end at the second end of the panel and a closed end spaced a distance from the first end of the panel; and at least one protrusion extending from the first end of the panel, the protrusion being matingly receivable in at least a portion of an opening of another deck block panel to interconnect the panel with said another deck block panel in an end-to-end relationship, wherein the first side of the panel has a mating portion extending from the first end to the second end adjacent to the bottom surface and a channel portion formed between the mating portion and the top surface, the mating portion being abuttable with a mating portion of said another deck block panel when the panel is interconnected to said another deck block panel in a side-by-side relationship and the channel portion cooperating with the channel portion of said another deck block panel to form a channel; and a rigid, U-shaped end cap positioned over at least a portion of the mating portion.

14. The deck block of claim 13 wherein the end cap extends along the entire length of the mating portion.

15. The deck block of claim 14 wherein end cap has a first flange and a second flange, and wherein the end cap is secured to the panel with at least one fastener extending upward through the first flange, the mating portion, and the second flange and a distance beyond the second flange such that the portion of the fastener extending beyond the second flange is disposed within the channel portion.

* * * * *

UNITED STATES PATENT AND TRADEMARK OFFICE

CERTIFICATE OF CORRECTION

PATENT NO. : 8,590,254 B2
APPLICATION NO. : 12/853078
DATED : November 26, 2013
INVENTOR(S) : David Michael Garrett It is certified that error appears in the above-identified patent and that said Letters Patent is hereby corrected as shown below:

In the Claims:
Column 8 line 12: After "end such that the" delete "hole".

Signed and Sealed this
Fourth Day of March, 2014

Michelle K. Lee

Michelle K. Lee
*Deputy Director of the United States Patent and Trademark Office*